US009534870B2

(12) United States Patent
Knies et al.

(10) Patent No.: US 9,534,870 B2
(45) Date of Patent: Jan. 3, 2017

(54) SHOCK TRANSFER ARMOR

(71) Applicants: David L. Knies, Marbury, MD (US); Alex E. Moser, Fort Washington, MD (US)

(72) Inventors: David L. Knies, Marbury, MD (US); Alex E. Moser, Fort Washington, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 399 days.

(21) Appl. No.: 13/921,648

(22) Filed: Jun. 19, 2013

(65) Prior Publication Data

US 2014/0208928 A1 Jul. 31, 2014

Related U.S. Application Data

(60) Provisional application No. 61/662,075, filed on Jun. 20, 2012, provisional application No. 61/777,511, filed on Mar. 12, 2013.

(51) Int. Cl.

| | |
|---|---|
| ***F41H 5/02*** | (2006.01) |
| ***F41H 7/00*** | (2006.01) |
| ***F41H 5/04*** | (2006.01) |

(52) U.S. Cl.

CPC ..... *F41H 5/02* (2013.01); *F41H 5/0492* (2013.01); *F41H 7/00* (2013.01)

(58) Field of Classification Search

CPC ..... F41H 5/06; F41H 5/013; F41H 5/24; F41H 5/02; F41H 5/00; F41H 7/04; F41H 7/02; F41H 7/048; F41H 7/042; F41H 7/044; F41H 7/046

USPC ..... 89/36.01, 36.02, 36.04, 36.07, 36.08, 89/36.09

See application file for complete search history.

(56) References Cited

U.S. PATENT DOCUMENTS

| | | | | |
|---|---|---|---|---|
| 4,449,446 | A * | 5/1984 | Degnan et al. | 92/146 |
| 5,102,723 | A * | 4/1992 | Pepin | 428/223 |
| 5,225,622 | A * | 7/1993 | Gettle et al. | 86/50 |
| 5,394,786 | A * | 3/1995 | Gettle et al. | 86/50 |
| 7,437,987 | B1 * | 10/2008 | Ohnstad et al. | 89/36.04 |
| 7,841,268 | B2 * | 11/2010 | Bailey | 89/36.02 |
| 8,316,752 | B2 * | 11/2012 | Waddell et al. | 89/36.02 |
| 8,522,664 | B2 * | 9/2013 | Chen et al. | 89/36.02 |
| 8,573,571 | B2 * | 11/2013 | Langhorst et al. | 267/151 |
| 8,590,437 | B2 * | 11/2013 | Gettle | 89/36.02 |
| 8,820,493 | B2 * | 9/2014 | Parida et al. | 188/268 |
| 2004/0118271 | A1 * | 6/2004 | Puckett et al. | 89/36.02 |

(Continued)

*Primary Examiner* — Benjamin P Lee

(74) *Attorney, Agent, or Firm* — US Naval Research Laboratory; Roy Roberts

(57) ABSTRACT

An armor system includes an appliqué comprising a high fluid retaining material (HFRM) and a plate configured to hold the appliqué against a compartment, wherein the armor system is adapted so that upon impact of a blast wave upon the plate, the HFRM is vented away from the compartment. The armor system may be adapted to a vehicle. In another embodiment, an armor system includes a plate operably connected to a plunger, one or more rods of brittle material operably contained within a tube, wherein the armor system is adapted so that upon impact of a blast shock wave upon the plate, the plate transfers the blast shock wave to the plunger and then to the contents of the tube. Optionally, the tube also contains HFRM.

12 Claims, 5 Drawing Sheets

(56) References Cited

U.S. PATENT DOCUMENTS

| | | | | |
|---|---|---|---|---|
| 2004/0154463 | A1* | 8/2004 | Edberg et al. | 89/36.04 |
| 2008/0190276 | A1* | 8/2008 | Barger et al. | 89/36.02 |
| 2008/0250916 | A1* | 10/2008 | Bailey | 89/36.02 |
| 2010/0307329 | A1* | 12/2010 | Kaswen et al. | 89/36.08 |
| 2011/0174144 | A1* | 7/2011 | Kuchinsky et al. | 89/36.02 |
| 2012/0216670 | A1* | 8/2012 | McDonald et al. | 89/36.02 |
| 2014/0007761 | A1* | 1/2014 | Haidar | 89/36.02 |
| 2014/0150636 | A1* | 6/2014 | Baron, Sr. | 89/36.02 |

* cited by examiner

SHOCK TRANSFER ARMOR

CROSS-REFERENCE TO RELATED APPLICATIONS

This Application claims the benefit of U.S. Provisional Application Nos. 61/662,075 and 61/777,511 filed on Jun. 20, 2012 and Mar. 12, 2013, respectively, each of which is incorporated herein by reference in its entirety.

BACKGROUND

In order to reduce harm to persons and property, it is desirable to mitigate high intensity impulses such as from blasts and projectiles. These impulses can arise from IEDs (Improvised Explosive Devices), mines, and the like.

BRIEF SUMMARY

An armor system includes an appliqué comprising a high fluid retaining material (HFRM) and a plate configured to hold the appliqué against a compartment, wherein the armor system is adapted so that upon impact of a blast wave upon the plate, the HFRM is vented away from the compartment.

In another embodiment, an armor system includes a plate operably connected to a plunger, one or more rods of brittle material operably connected to the plunger and contained within a tube, and a high fluid retaining material (HFRM) also contained within the tube, wherein the armor system is adapted so that upon impact of a blast shock wave upon the plate, the plate transfers the blast shock wave to the plunger and thence to the contents of the tube.

In yet another embodiment, an armor system includes a plate operably connected to a plunger, one or more rods of brittle material operably connected to the plunger and contained within a tube, wherein the armor system is adapted so that upon impact of a blast shock wave upon the plate, the plate transfers the blast shock wave to the plunger and thence to the contents of the tube. Optionally, the tube also contains HFRM.

BRIEF DESCRIPTION OF THE DRAWINGS

FIG. 4B illustrates a tube including a plate, plunger, brittle material, and HFRM assemblage. The left image, FIG. 4A, is a magnified view showing a cross-section of HFRM filling above the level of the brittle material within the tube. The right image, FIG. 4C, is a magnified view showing a cross-section of top of brittle material cylinders.

DETAILED DESCRIPTION

Definitions

Before describing the present invention in detail, it is to be understood that the terminology used in the specification is for the purpose of describing particular embodiments, and is not necessarily intended to be limiting. Although many methods, structures and materials similar, modified, or equivalent to those described herein can be used in the practice of the present invention without undue experimentation, the preferred methods, structures and materials are described herein. In describing and claiming the present invention, the following terminology will be used in accordance with the definitions set out below.

As used in this specification and the appended claims, the singular forms "a", "an," and "the" do not preclude plural referents, unless the content clearly dictates otherwise.

As used herein, the term "and/or" includes any and all combinations of one or more of the associated listed items.

As used herein, the term "about" when used in conjunction with a stated numerical value or range denotes somewhat more or somewhat less than the stated value or range, to within a range of ±10% of that stated.

As used herein, the term "high fluid retaining material" or "HFRM" refers to a material that is able to absorb from 50% to up to 1000% of its weight in water.

Description

Mitigation of high intensity impulses from blasts caused by improvised explosive devices (IEDs) or land mines is critical to prevent injury to warfighters and non-combatants. For blast mitigation, it can be shown from first principle momentum and energy conservation arguments that the minimum momentum and kinetic energy transfer occurs for a maximum inelastic collision. To accomplish this requires a structure that both maximizes energy dissipation and provides ideal coupling.

As described herein and in a related application entitled "Materials and Processes for Coupling Impulses and Shockwaves into Solids," appliqués are developed to better match the impedance of the shock wave and blast products while allowing for energy dissipation. In one embodiment, the two functions (dissipation and coupling) are provided into two separate appliqués, however, it is possible to integrate the two functions into a single appliqué.

Figure 1:
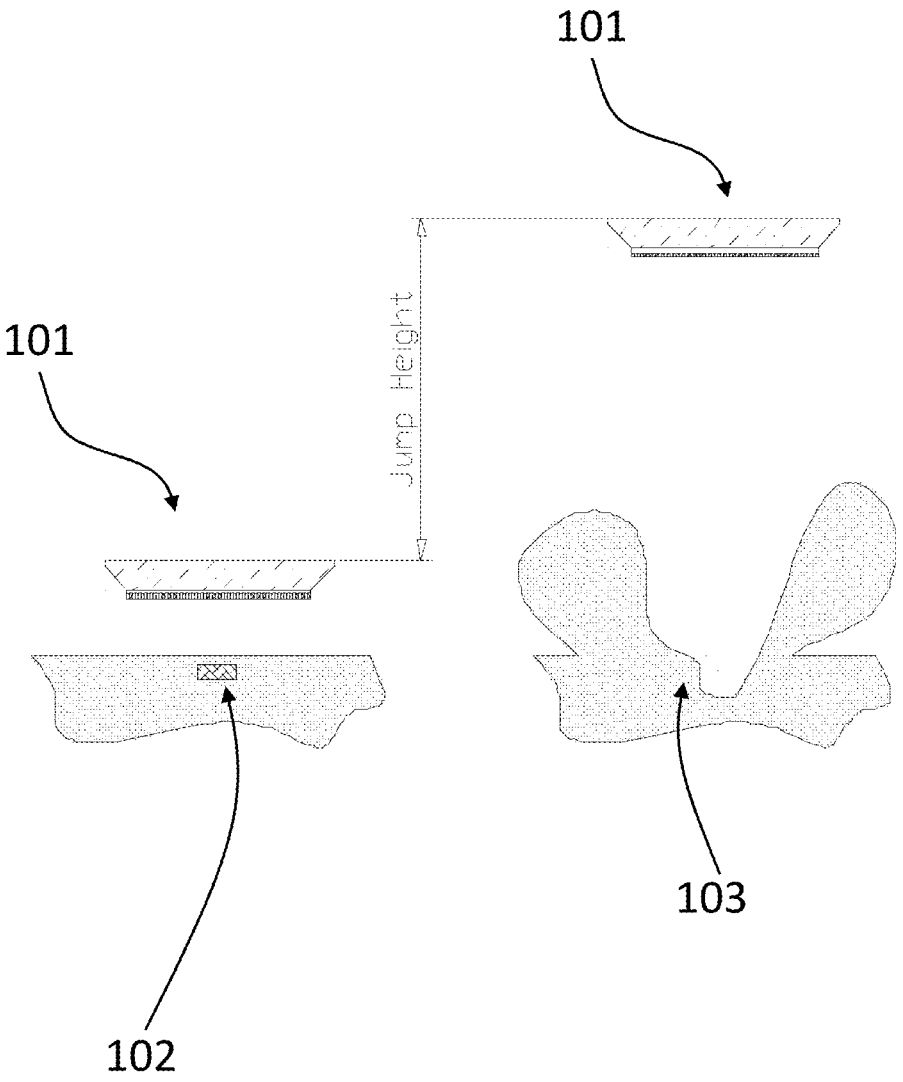
FIG. 1 schematically illustrates a test configuration.

Jump height provides relevant and reliable data associated with blast testing of the device under test (DUT). An exemplary jump height test configuration is shows in FIG. 1. With the armor system 101 under test positioned above the simulated threat 102, a blast 103 is triggered, causing the armor system 101 to jump. The jump height is used to calculate momentum and energy transfer to the DUT by assuming the DUT starts at rest, and is again at rest at the maximum jump height. At this point, the kinetic energy imparted to the DUT by the threat is converted to potential energy.

Armor System Design

One example of impulse mitigation involves a brittle material, such as glass, fracturing, adsorbing energy from the impulse, and preventing the impulse energy from harming personnel and equipment (see U.S. Pat. No. 8,176,831 and US Patent Publication Nos. 2011/0203452, each of which is incorporated herein by reference).

High fluid retaining materials (HFRM) such as sodium polyacrylate (NAPA) and polyvinyl alcohol (PVA) are able to absorb 50% to 800% or in some cases up to 1000% their weight in water, depending on process conditions and environmental factors. Normally, bulk water and other fluids that are shear thickening can be utilized to amplify, rather than mitigate a blast wave, due to several factors including water coherently vaporizing at its interface upon passage of a blast wave through its bulk and pressure dependent hydrogen bonding. Thus, it is undesirable to use a contiguous gel or fluid in the armor system.

However, a HFRM made of small distributed volumes such as spheres or fibers adjacent to voids (air) would react to a blast wave in a non-coherent manner, i.e., vaporization of retained fluid would occur at different rates throughout the distributed system and counter act the blast pressure wave rather than reinforce it. This distributed system would have a surface area per unit volume orders of magnitude greater than a bulk fluid structure, enabling a significantly greater aggregate transformation rate of the fluid to its vapor phase, and as a result, absorb a significant portion of the blast wave energy. In addition, these materials are also shear thinning, that is the viscosity decreases with increased stress allowing the momentum and energy of the shockwave to be transferred the medium. Further, materials such as water vapor, experiencing blast wave pressures and temperatures can undergo transformation to a supercritical fluid state, lowering their viscosity and resistance to flow significantly.

Beads or pellets of HRFM material are commercially available in a wide variety of sizes. In one embodiment, beads exist in a dry form with the majority having sizes between 150 μm and 500 μm, swelling with water to about 3 mm. Larger pellets may be used, such as those of about 2 cm. Preferably, the HRFM is fully hydrated or nearly fully hydrated (e.g., about 99.9%, 99%, 98%, 95%, or 90% hydrated).

In a soil blast test, jump height was reduced from 182 inches in a control to 134 inches when using NAPA, a reduction of 25%.

Additionally, the distributed HFRM can be used to redirect the blast wave momentum away from a volume designated for personnel, such as the volume of a troop transport vehicle; the mine resistant ambush protected (MRAP) vehicle. In non-dissipative systems momentum is constrained to be conserved. Thus, the momentum of the initial blast wave must be conserved as that momentum is transferred to the vehicle. The vaporized fluid from the HFRM significantly lowers the HRFM's viscosity allowing it to flow in rapid response to pressure gradient components of the blast wave, and if the armor structure is design appropriately, redirect the momentum and energy of the blast wave away from the vehicle compartment as shown in FIG. 2.

Figure 2:
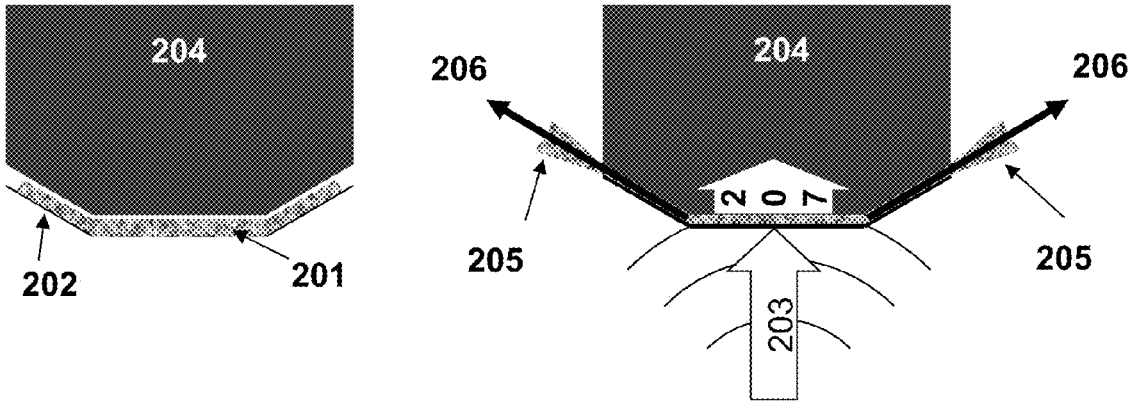
FIG. 2 schematically illustrates a high fluid retaining materials (HFRM) system before blast (left) and during blast (right).

Such an embodiment shown is illustrated in FIG. 2, where a plate or other suitable container 202 holds the HRFM 201 in position around the vehicle compartment. In a case of a blast, the blast wave momentum 203 is directed away from the vehicle compartment 204 as the HFRM jets 205 redirect the momentum vector 206, resulting in low transfer of momentum 207 to the vehicle compartment. The vector momentum summation is directed through the vehicle compartment, but this sum vector is virtual and has little if any direct effect on personnel residing within the compartment. The plate 202 holding the NAPA or other HRFM in place can be made of metal or other materials such as plastics, or other composite or laminate structures; it merely is required to have enough structural integrity to maintain fieldability.

In blast testing of an embodiment as shown in FIG. 2, using sodium polyacrylate (NAPA) in water mounted on a plate with 45° plate wings decreased jump height from 234 inches in the control to 106 inches, a decrease of 54%.

Figure 3:
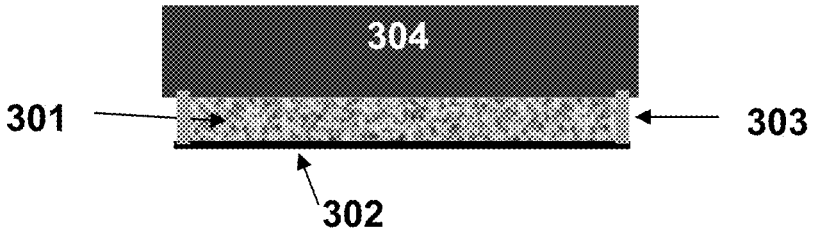
FIG. 3 schematically illustrates another embodiment wherein HFRM material is affixed to the bottom of a protected structure (such as a vehicle) having a flat bottom.

FIG. 3 illustrates another embodiment wherein HFRM material is affixed to the bottom of a protected structure (such as a vehicle) having a flat bottom. The HRFM 301 is contained by a thin plate 302 (for example, made of metal, polymer, composite, and/or laminate) and thin-walled material on the sides 303 to allow the side walls to blow out, protecting the vehicle compartment 304 in the event of a blast. In this embodiment, the HFRM material system acts primarily as an energy absorbing material. The kinetic energy of the material and the vaporization of the fluid absorbed in the material serve to absorb blast energy.

Incorporating One or More Brittle Rods

In addition to one or more of the armor elements described therein, it is possible to include a vertical tube contains a plunger, one or more brittle rods (comprising glass, ceramic, or a mixture thereof) designed to adsorb energy through a number of processes including fracture, and a high fluid retaining material (HFRM) such as sodium polyacrylate (NAPA) material surrounding the brittle rods.

Figures 4A, 4B, 4C:
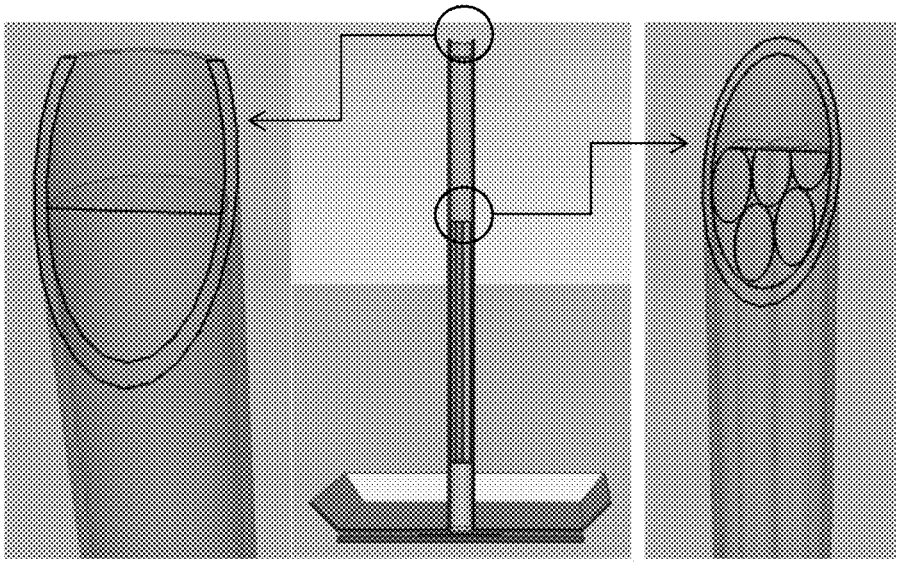
FIGS. 4A through 4C schematically illustrate still another embodiment. The center image.

Such embodiments are shown in FIGS. 4A through 4C. The center image, FIG. 4B illustrates a tube including a plate, plunger, brittle material, and HFRM assemblage. The left image, FIG. 4A, is a magnified view showing a cross-section of HFRM filling above the level of the brittle material within the tube. The right image, FIG. 4C, is a magnified view showing a cross-section of top of brittle material cylinders. The image shows 7 cylinders, but any number can be accommodated from 1 to a bundle of cylinders, for example having diameters similar to fiber optic wire.

The basin-like structure with the 45° angled sides serves as a representation of the vehicle underbody. There is a large plate under the vehicle body that may contain HFRM material. This plate is preferably comprised of a metal, metal alloy, metal matrix composite, and the like that functions to contain energy absorbing material such as HFRM. It may or may not be shaped to conform to the vehicle underbody shape; in this case the plate does not conform to the vehicle 45° angled sidewall. Atop the large plate is a smaller plate. This plate is comprised of a metal, metal alloy, metal matrix composite, and the like that functions to have appropriate structural integrity to transfer the blast shock wave to the plunger. Atop the small plate is a plunger. The plunger is comprised of a metal, metal alloy, metal matrix composite, and the like that functions to have appropriate structural integrity to transfer the blast shock wave to the brittle material. Atop the plunger is brittle material designed to absorb the blast energy through several mechanisms including fracture and transfer blast energy through acceleration of the fractured brittle material. The HFRM serves to (1) absorb blast energy through a phase transformation, and (2) absorb blast energy through HFRM particle acceleration.

Additional Test Results

Figure 5A:
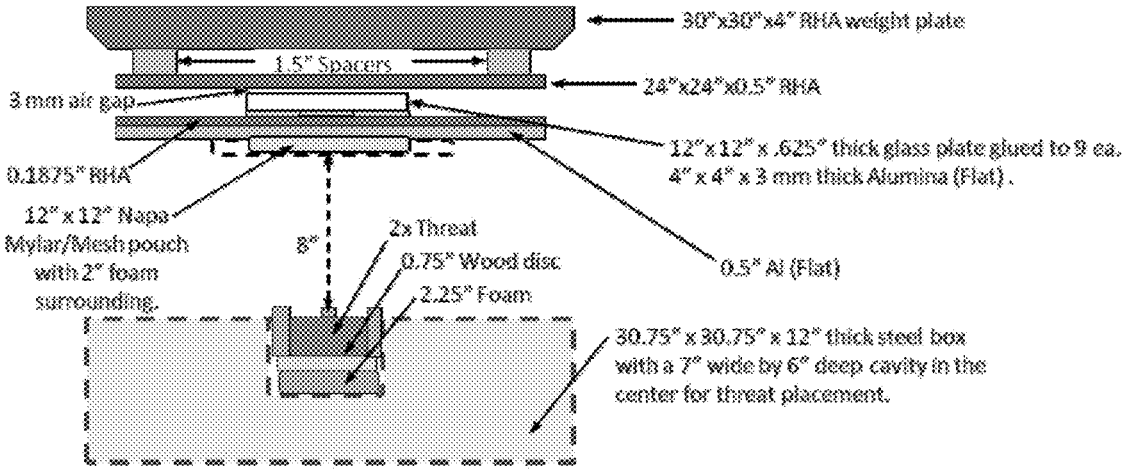
FIGS. 5A through 5C illustrate various test configurations used.
Figure 5B:
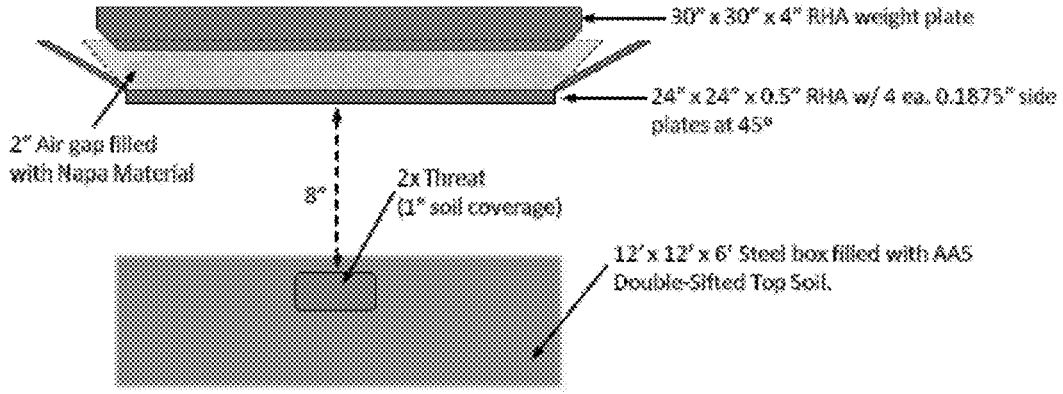
Figure 5C:
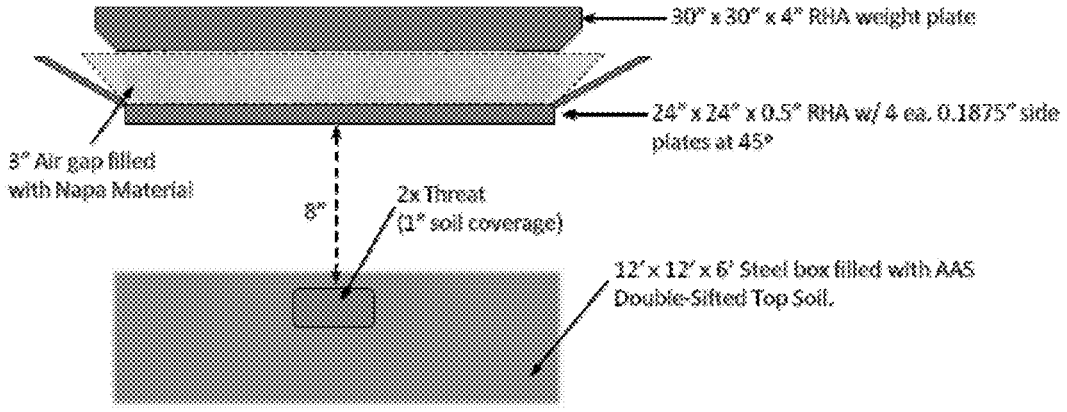

Additional blast testing was conducting using various configurations as shown in FIGS. 5A through 5C

TABLE 1

Results of additional blast testing. Pot: Charge is placed in steel pot. Top of charge is level with ground. In Ground: Charge top is 1 inch below ground in water saturated soil

| Shot | Configuration | Location | Charge Size | Energy Reduction (%) | Impulse Reduction (%) |
|---|---|---|---|---|---|
| 31 | Sol. 3- C (NAPA) | Pot | 2 × C4 | 19.7 | 7.2 |
| 41 | Solution 4 - EA (2" NAPA) | In Ground | 2 × C4 | 47.2 | 24.6 |
| 43 | Solution 4 - EA (3" NAPA) | In Ground | 2 × TNT | 27.0 | 10.6 |

For Shot 31, the target configuration (top to bottom) was as follows and is illustrated in FIG. 5A.

1. 30"×30"×4" thick RHA Weight
2. 1.5" A1 Spacers
3. 24"×24"×0.5" RHA
4. 3 mm air gap
5. 12"×12"×0.625" Glass
6. 3 mm Alumina Amplifier—Flat (9 ea. 4"×4" tiles—3×3 grid)
7. 24"×24"×0.1875" RHA
8. 0.5" A1
9. 12"×12" Napa Mylar/Mesh pouch with 2" foam surrounding Total Target Weight: 1,089.3 lbs.

For Shot 31, the target configuration (top to bottom) was as follows and is illustrated in FIG. 5B.

Target Configuration (from top to bottom):

1. 30"×30"×4" thick RHA Weight
2. 2" Air gap filled with Napa Material
3. 24"×24"×0.5" RHA Total Target Weight: 1,092.6 lbs.

For Shot 43, the target configuration (top to bottom) was as follows and is illustrated in FIG. 5C.

1. 30"×30"×4" thick RHA Weight (Previously used on Shot 41)
2. 3" Air gap filled with Napa Material
3. 24"×24"×0.5" RHA Total Target Weight: 1,106.8 lbs All documents mentioned herein are hereby incorporated by reference for the purpose of disclosing and describing the particular materials and methodologies for which the document was cited.

Although the present invention has been described in connection with preferred embodiments thereof, it will be appreciated by those skilled in the art that additions, deletions, modifications, and substitutions not specifically described may be made without departing from the spirit and scope of the invention. Terminology used herein should not be construed as being "means-plus-function" language unless the term "means" is expressly used in association therewith.

What is claimed is:

1. An armor system comprising:

A compartment;

an applique comprising a high fluid retaining material (HFRM) in the form of small distributed volumes of HFRM adjacent to air, such that the HFRM is shear thinning with a viscosity that decreases with increased stress, and a plate configured to hold the applique against the compartment and contain the HFRM, wherein the armor system is configured so that upon impact of a blast wave upon the plate, the HFRM is directed away from the compartment.

2. The armor system of claim 1, wherein said HFRM is selected from sodium polyacrylate and polyvinyl alcohol.

3. The armor system of claim 1, wherein said HFRM is in a condition of being at least 90% hydrated.

4. The armor system of claim 1, wherein said HFRM comprises beads and when said beads are in a condition of being dried, a majority said beads have sizes between 150 μm and 500 μm.

5. The armor system of claim 1, wherein the compartment is V-shaped.

6. The armor system of claim 1, wherein the plate comprises metal, plastic, laminate, or a combination thereof.

7. An armored vehicle comprising:

a compartment;

an applique on an exterior of the compartment, the applique comprising a high fluid retaining material (HFRM) in the form of small distributed volumes of HFRM adjacent to air, such that the HFRM is shear thinning with a viscosity that decreases with increased stress, and a plate configured to hold the applique in place and contain the HFRM, wherein the armor system is configured so that upon impact of a blast wave upon the plate, the high fluid retaining material is directed away from the compartment.

8. The armor system of claim 7, wherein said HFRM is selected from sodium polyacrylate and polyvinyl alcohol.

9. The armor system of claim 7, wherein said HFRM is in a condition of being at least 90% hydrated.

10. The armor system of claim 7, wherein said HFRM comprises said beads and when said beads are in a condition of being dried, a majority said beads have sizes between 150 μm and 500 μm.

11. The armor system of claim 7, wherein the compartment is V-shaped.

12. The armor system of claim 7, wherein the plate comprises metal, plastic, laminate, or a combination thereof.

* * * * *